US006178606B1

(12) United States Patent
Glendon

(10) Patent No.: US 6,178,606 B1
(45) Date of Patent: Jan. 30, 2001

(54) SHOELACE LOCK

(76) Inventor: Sean T Glendon, 25 Keystone Rd., Yonkers, NY (US) 10710

( * ) Notice: Under 35 U.S.C. 154(b), the term of this patent shall be extended for 0 days.

(21) Appl. No.: 09/336,855

(22) Filed: Jun. 21, 1999

(51) Int. Cl.[7] ..... A43C 1/00
(52) U.S. Cl. ..... 24/712.5; 24/115 G
(58) Field of Search ..... 24/115 G, 136 R, 24/115 M, 712.5; 174/146; 439/816, 817; 36/50.1

(56) References Cited

U.S. PATENT DOCUMENTS 2,236,506 * 4/1941 Hirsch .
2,791,335 * 5/1957 Leebow .
3,080,867 * 3/1963 Eichinger .
4,393,550 * 7/1983 Yang et al. .
4,453,292 * 6/1984 Bakker .
5,323,514 * 6/1994 Masuda et al. .
5,345,657 * 9/1994 Shimizu .
5,365,641 * 11/1994 Watanabe et al. .
5,924,178 * 7/1999 Holmberg .
6,026,548 * 2/2000 Jackson .

FOREIGN PATENT DOCUMENTS

641586 * 2/1937 (DE) .
229883 * 7/1998 (EP) .
4232 * of 1882 (GB) .

* cited by examiner

*Primary Examiner*—James R. Brittain
(74) *Attorney, Agent, or Firm*—Michael I Kroll

(57) ABSTRACT

The present invention 10 discloses a device for securing the shoelaces 28 on shoes 18. The device 10 comprises an outer cylinder 12 being open on one end having apertures 14 positioned in the longitudinal walls thereof for receiving an inner member 16. The inner member 16 is also cylindrically shaped having apertures 14 passing therethrough with a head 36 on one end. The apparatus functions by positioning the inner member 16 on the inside of the outer cylinder 12 whereby the apertures 14 are aligned and thereafter threading the shoelace 28 through the aperture 14 of the outer cylinder 12 and the inner member 16. Thereafter a spring 38 placed longitudinally in the bottom 40 of the outer cylinder 12 communicating with the bottom of the outer cylinder and the tip 42 of the inner member 16 biases outwardly the inner member 16 so as to bind the shoestrings 28 between the apertures 14 of the outer cylinder 12 and the apertures 14 of the inner member 16 thereby securing the shoestrings 28.

3 Claims, 7 Drawing Sheets

SHOELACE LOCK

BACKGROUND OF THE INVENTION

1. Field of the Invention

The present invention relates generally to shoes and, more specifically, to a device which is placed on the shoe which will prevent the shoelaces from untying and unthreading. The device is comprised of an outer cylindrical member having a plurality of oppositely opposed apertures in the wall and a second cylindrical member having an outside diameter substantially equal to the inside diameter of the outer member. The inside cylindrical member also has a plurality of oppositely opposed apertures in the wall. The inner cylindrical member is under constant spring pressure toward the open end of the outer member. After the shoelaces are threaded through the shoelace eyelets the device is positioned for use. The inner member is depressed until its apertures are in alignment with the outer member the end of the shoelace is then passed through both members. When both end of the shoelace have been passed through the device the inner member is release and the shoelaces are held by the spring pressure between the two cylindrical members.

2. Description of the Prior Art

The normal method of securing shoelaces by creating a double knot does not insure that the shoelaces will not become untied. But does work well in many instances, often too well. In sporting events there is an increased force placed on the shoelaces which can create a knot which is extremely difficult to undo. This can prove to be especially difficult when dealing with small children.

In sporting events and active children the single knot invariably comes untied. Therefore it is felt that a need exists for a device which will grip the shoelaces in a selective position and maintain said position even in active play. It is also felt that such a device should be easy to use.

SUMMARY OF THE PRESENT INVENTION

The present invention discloser a device for securing the shoelaces on shoes. The device comprises an outer cylinder being open on one end having apertures positioned in the longitudinal walls thereof for an inner member. The inner member is also cylindrically shaped having apertures passing therethrough with a head on one end. The apparatus functions by postioning the inner member on the inside of the outer cylinder whereby the apparatus are aligned and thereafter threading the shoelace through the aperture of the outer cylinder and the inner member. Thereafter a spring placed longitudinally in the bottom of the outer cylinder communicating with the bottom of the outer cylinder and the tip of the inner member biases outwardly the inner member so as to bind the shoesstring between the apertures of the outer cylinder and the apertures of the inner member thereby securing the shoestrings.

A primary object of the present invention is to provide a device for holding the shoelaces in a selective position.

Another object of the present invention is to provide a device having an outer member having a plurality of apertures for passing the ends of shoelaces therethrough.

Another object of the present invention is to provide a device having an inner member having a plurality of apertures in substantially the same position as the outer member for passing the ends of shoelaces therethrough.

A still further object of the present invention is to provide a device having an inner member having a plurality of apertures in substantially the same position as the outer member and spring means providing a force between the inner and outer member.

A yet further object of the present invention is to provide a device which can be used by children while they are learning to tie their shoelaces.

Another object of the present invention is to provide a device which can be used to fix the shoelaces into a selective position without having to tie them, such as temporarily injured, the elderly, children or just a desire to use laced shoes as slippers.

Additional objects of the present invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become more fully appreciated as the same becomes better understood when considered in conjunction with the accompanying drawings, in which like reference characters designate the same or similar parts throughout the several views.

Figure 1:
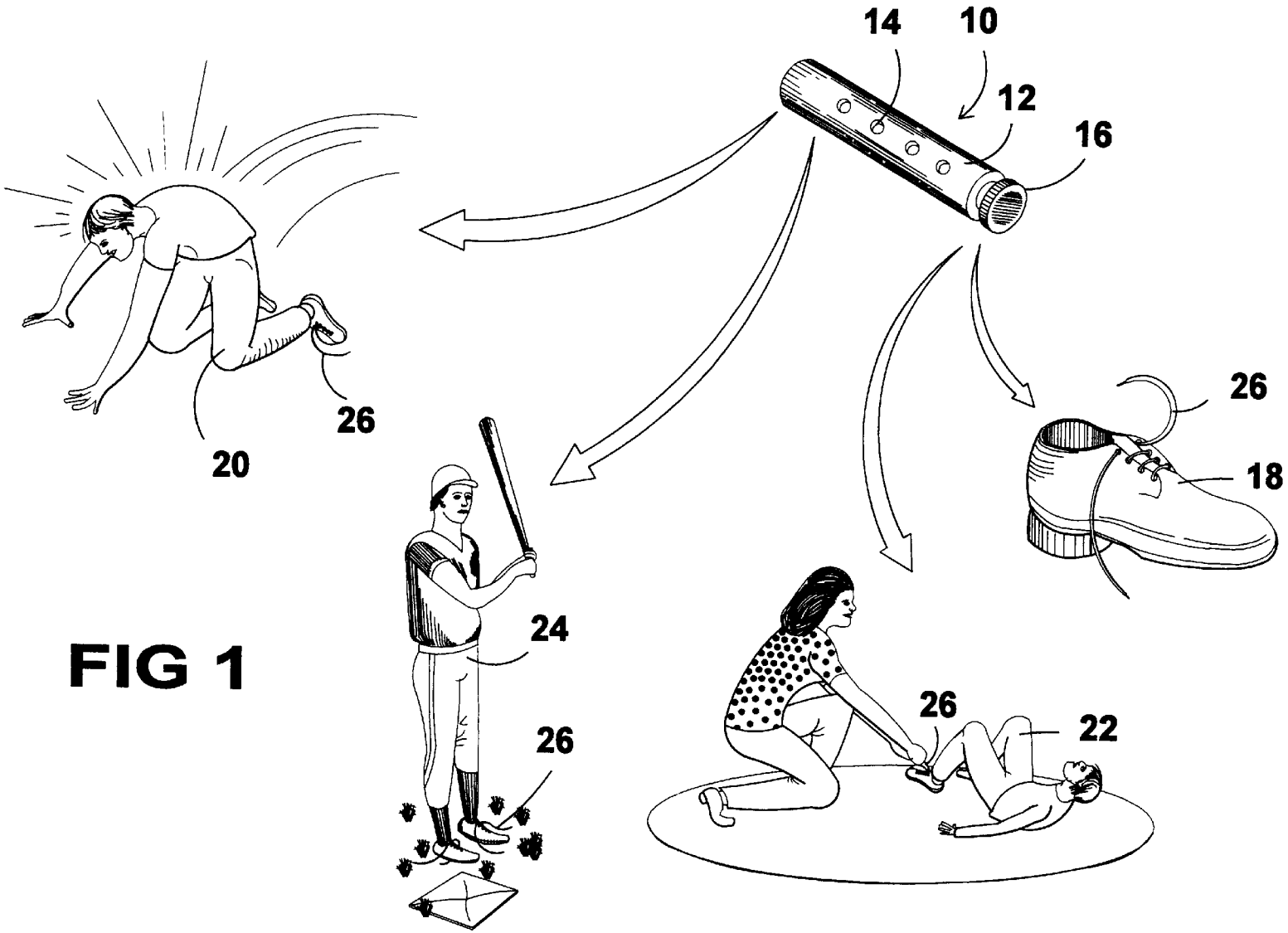
FIG. 1 is an illustrative view of various situations where an untied shoelace can be hazardous to an individual, such as sporting events and a constant chore for parents to continuously keep and eye on children while the are playing. Small children have a tendency to ignore untied shoelaces because they don't perceive any danger and haven't learned to tie them, so it is easy to ignore them rather than to stop play.

The following detailed description is, therefore, not to be taken in a limiting sense, and the scope of the present invention is best defined by the appended claims.

LIST OF REFERENCE NUMERALS

With regard to reference numerals used, the following numbering is used throughout the drawings.

10 present invention
12 outer cylinder
14 apertures
16 inner cylinder
18 shoes
20 adult
22 child
24 athlete
26 untied shoestring
28 shoelaces
30 eyelets
32 knot
34 bore
36 head
38 spring
40 end
42 tip
44 force arrows

DESCRIPTION OF THE PREFERRED EMBODIMENT(S)

Turning now descriptively to the drawings, in which similar reference characters denote similar elements throughout the several views, FIGS. 1 through 6 illustrate the present invention being a device for maintaining shoestrings in the tied position.

Turning to FIG. 1, therein is shown an illustrative view of various situations where an untied shoelace can be hazardous to an individual, such as sporting events and a constant chore for parents to continuously keep an eye on children while they are playing. Small children have a tendency to ignore untied shoelaces because they don't perceive any danger and haven't learned to tie them, so it is easy to ignore them rather than to stop play. Shown therein is the present invention generally shown at 10 having an outer cylindrical member 12 having apertures 14 therein along with an inner cylindrical member 16. Also shown therein is an untied shoe 18 and strings 26, a person 20 who has tripped over his shoes with untied shoestrings 26, a child 22 having his untied shoestrings 26 tied by all adult along with an athlete 24 also having untied shoestrings 26.

Figure 2:
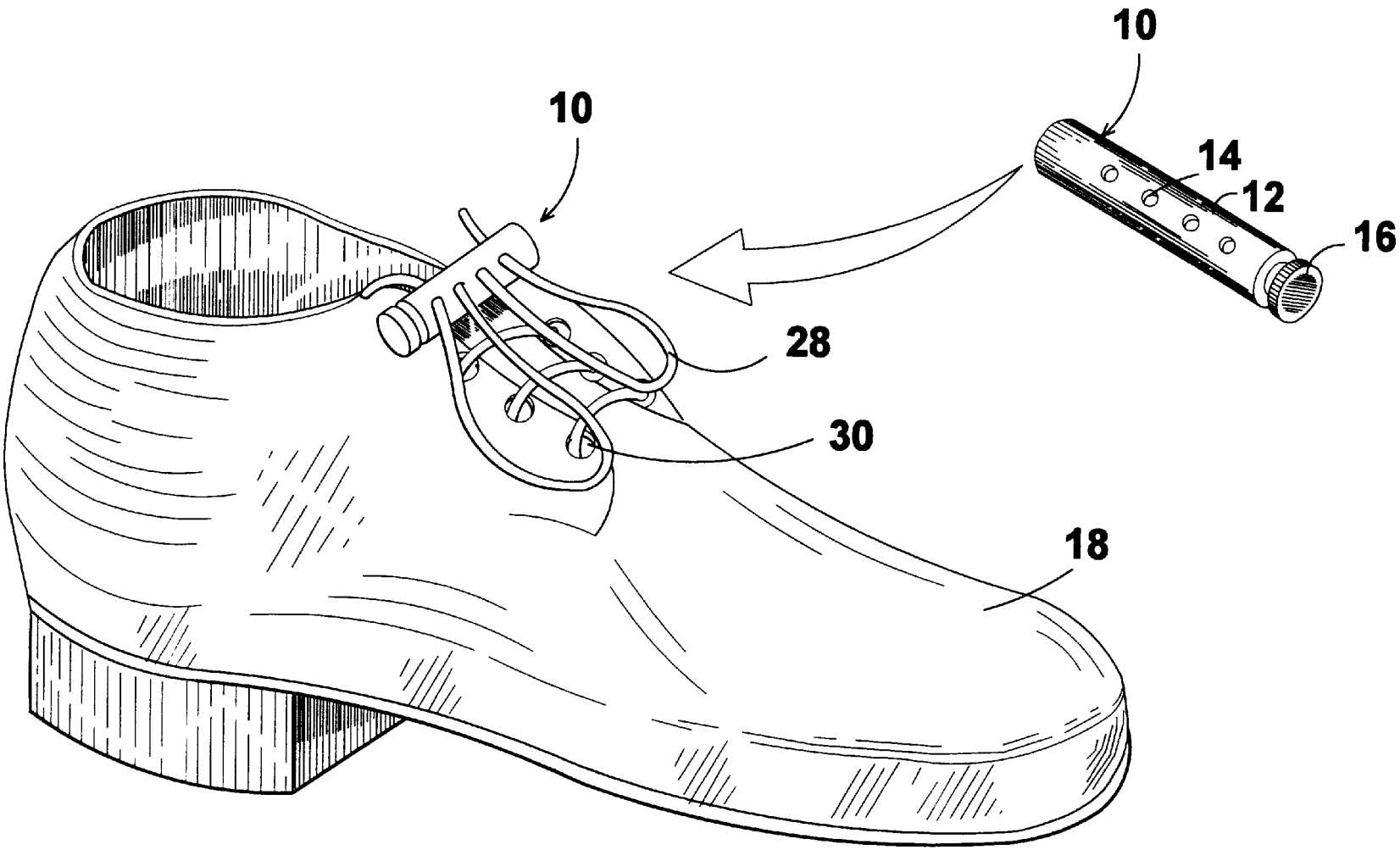
FIG. 2 is a perspective view, taken from FIG. 1 as indicated, showing the present invention installed on a shoe. The shoelaces having been threaded through the shoelace eyelets are passed through the device while maintaining alignment of the apertures between the outer and inner members. The release of the inner member will permit the spring to extend the inner member to a point where the shoelaces are securely engaged between the apertures of the outer member and the apertures of the inner member which is continuously under spring pressure.

Turning to FIG. 2, therein is shown a perspective view, taken from FIG. 1 as indicated, showing the present invention 10 installed on a shoe 18. The shoelaces 28 having been threaded through the shoelace eyelets 30 are passed through the apertures 14 of the device 10 while maintaining alignment of the multiple apertures 14 between the outer 12 and inner 16 members by pushing the inner member 16 inwardly of the outer member 12. The release of the inner member 16 will permit the internal coil spring (not shown) positioned inside inner member 12 to extend or move the inner member 16 to a point where the shoelaces 28 are securely engaged between the apertures 14 of the outer member 12 and the apertures (not shown) of the inner member 16 which is continuously under spring pressure.

Figure 2A:
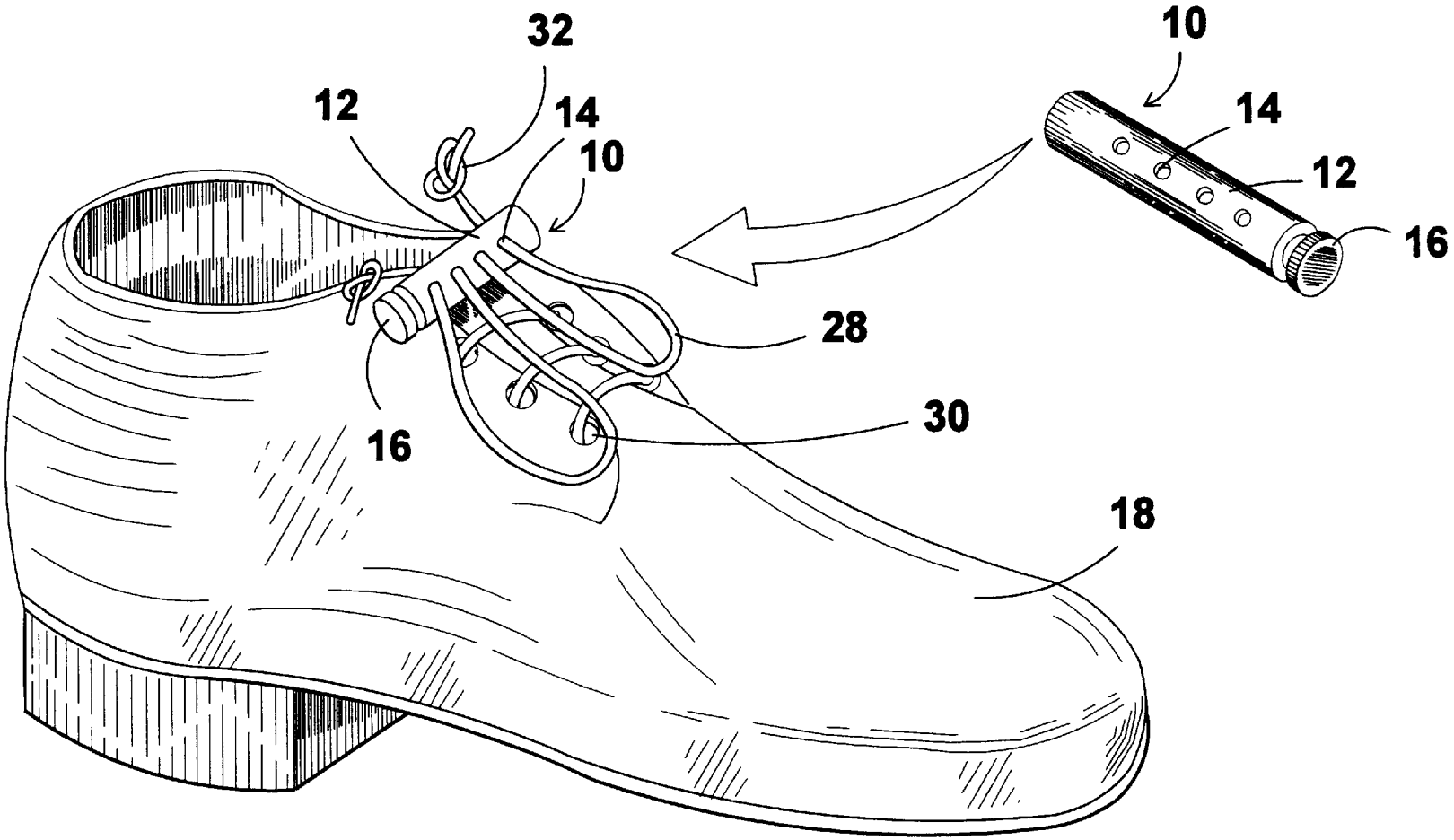
FIG. 2A is a perspective view of the shoe as shown in FIG. 2, where the ends of the shoelaces have been knotted. This will provide a permanent installation of the lace lock to a shoe. The shoelaces having been threaded through the shoelace eyelets are passed through the device while maintaining alignment of the apertures between the outer and inner members. The release of the inner member will permit the spring to extend the inner member to a point where the shoelaces are securely engaged between the apertures of the outer member and the apertures of the inner member which is continuously under spring pressure.

Turning to FIG. 2A, therein is shown a perspective view of the shoe 18 as shown in FIG. 2, where the ends of the shoelaces 28 have been knotted 32. This will provide a permanent installation of the lace lock 10 to a shoe 18. The shoelaces 28 having been threaded through the shoelace eyelets 30 are thereafter passed through the apertures 14 of the device 10 while maintaining alignment of the apertures 14 between the outer 12 and inner 16 members. The release of the inner member 16 will permit the spring (not shown) to extend the inner member 16 to a point where the shoelaces 28 are securely engaged between the apertures 14 of the outer member 12 and the apertures 14 of the inner member 16 which is continuously under spring pressure.

Figure 3:
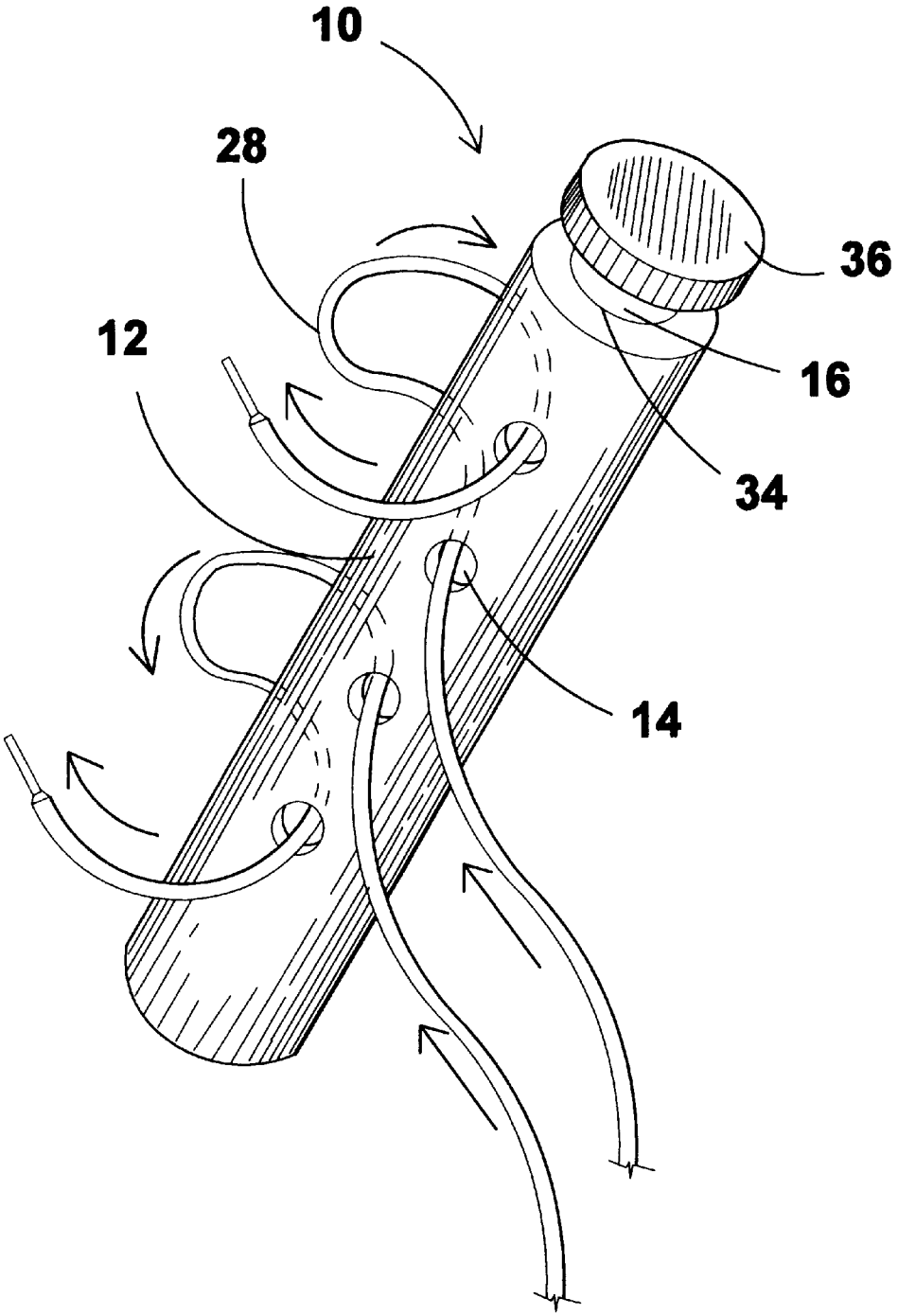
FIG. 3 is a perspective view of the present invention showing one means threading the shoelaces through the outer and inner member while holding the outer and inner member apertures in alignment and the passing the back through from the other side before releasing the inner member which will grip the shoelaces between the two members because of the spring inserted between the members. The shoelaces can be inserted one or more times as desired.

Turning to FIG. 3, therein is shown a perspective view of the present invention 10 showing one means of threading the shoelaces 28 through the outer 12 and inner 16 member while holding the outer and inner member apertures 14 in alignment and then passing the shoelaces 28 back through the apertures from the other or opposite side of the members 12, 16 before releasing the inner member 16. This will allow the shoelaces 28 to be secured between the two members 12, 16 because of the spring (not shown) inserted between the members 12, 16. The shoelaces 28 can be inserted through apertures 14 one or more times as desired. The bore 34 of the outer cylinder 12 can be seen with the inner member's shaft 16 being substantially equal in diameter to the diameter of the outer cylinder 12. The head 36 of the inner cylinder 16 is also shown.

Figure 4:
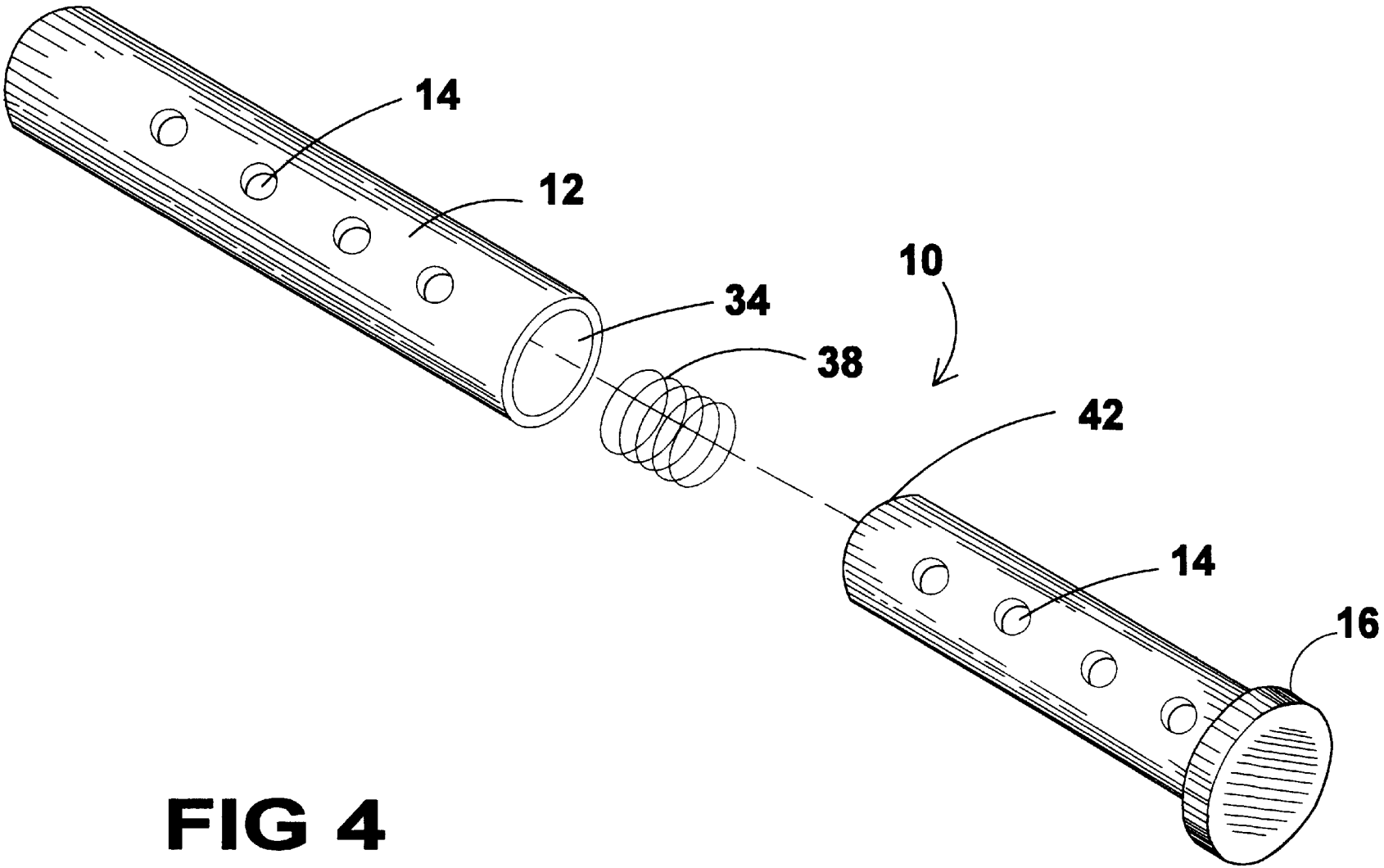
FIG. 4 is an exploded view of the present invention. Shown is a housing having an insertable member having matching apertures therein. Also shown is a spring which provides securing means by employing a continuous outward pressure on the inner member.

Turning to FIG. 4, therein is shown an exploded view of the present invention 10. Shown is an outer housing 12 having an insertable movable rod-like member 16 having matching multiple apertures 14 therein. Also shown is a coiled spring 38 which provides securing means for the shoelaces by employing a continuous outward pressure on the inner member 16. Spring 38 is longitudinally positioned in bore 34 so as to put outward pressure on the tip of member 16.

Figure 5:
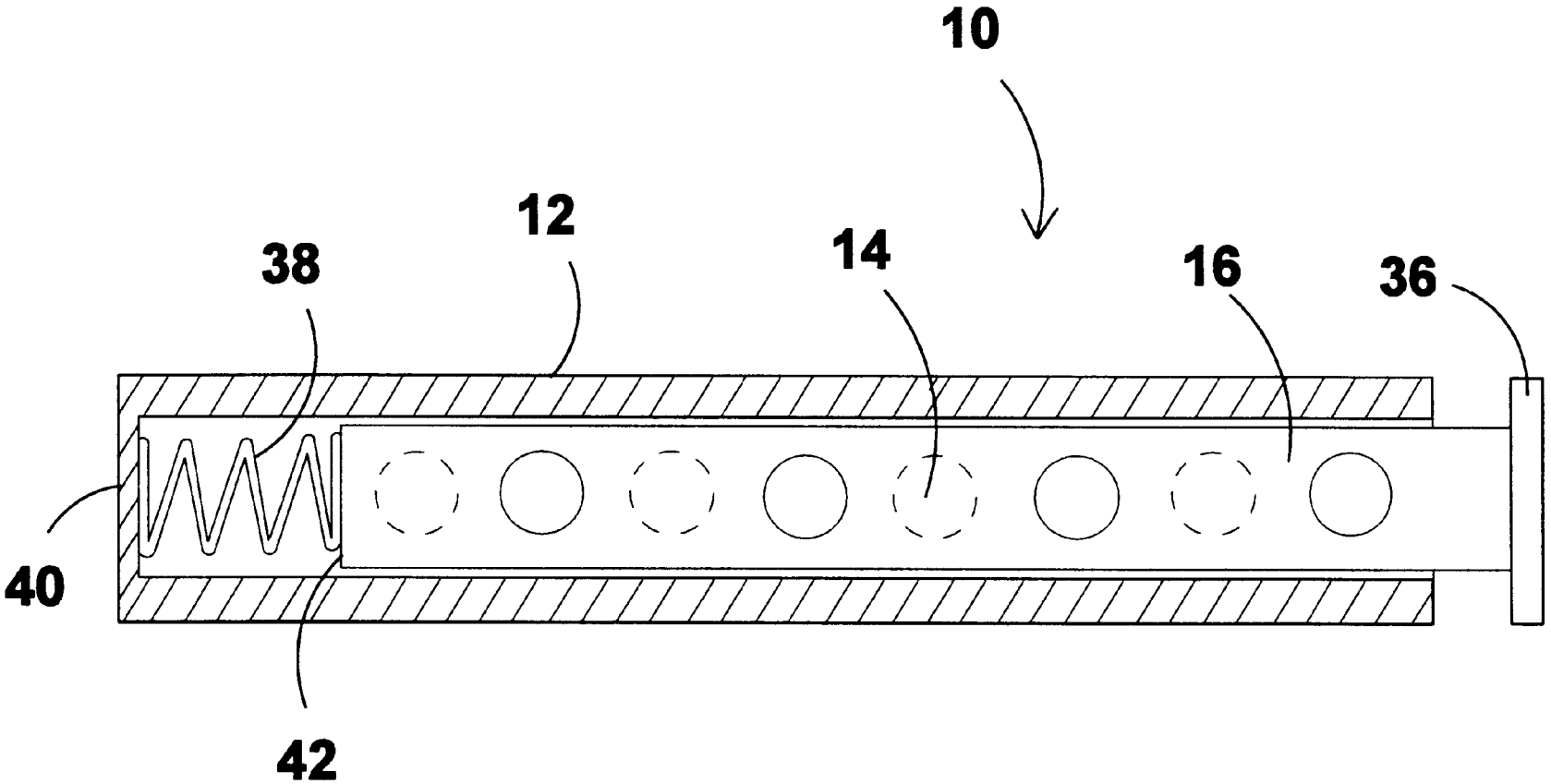
FIG. 5 is a cutaway view of the present invention showing the apertures of the inner member being forced out of alignment with the aperture of the outer member by the spring positioned between the members.

Turning to FIG. 5, therein is shown a cutaway view of the present invention 10 showing the apertures 14 of the inner member 16 being forced out of alignment with the aperture 14 of the outer member 12 (shown in outline) by the spring 38 positioned between the members 12, 16. Spring 38 is shown positioned between the base end 40 of outer cylinder 12 and the tip 42 of the inner member 16.

Figure 6:
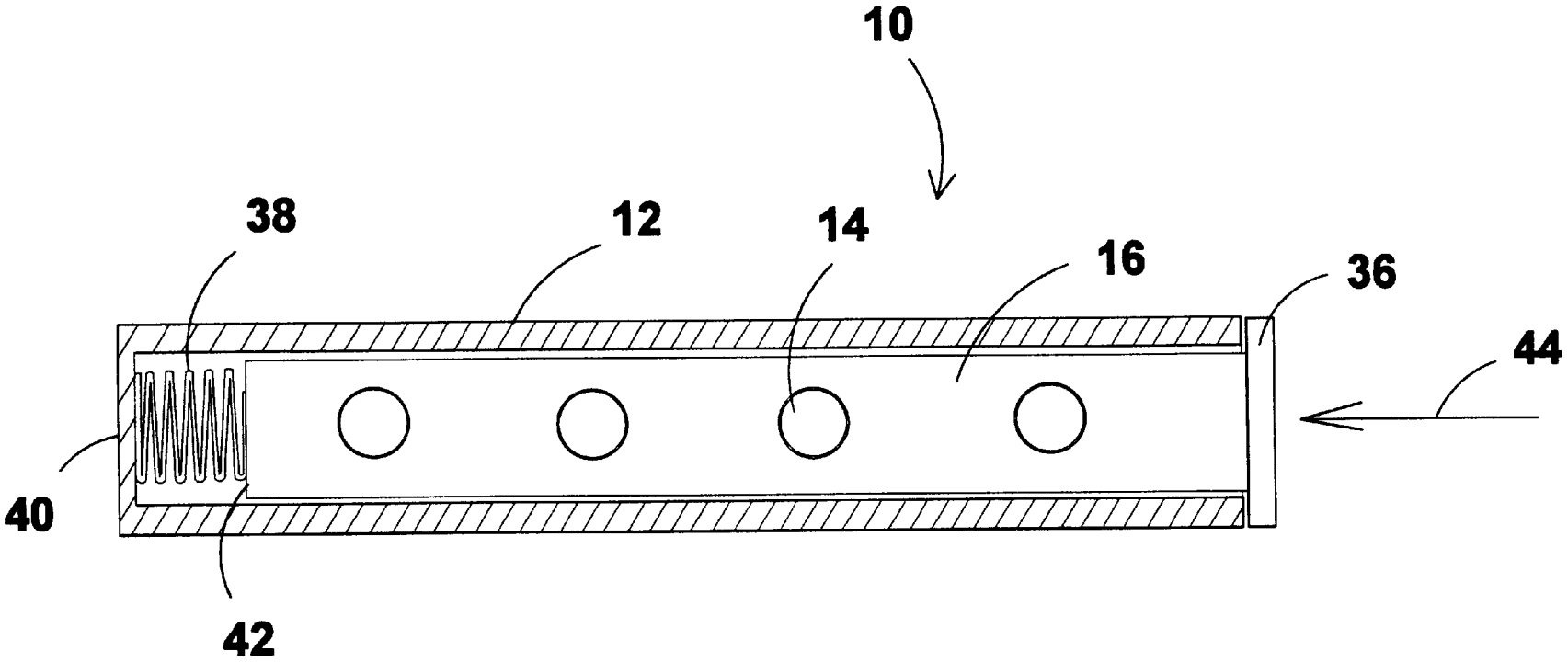
FIG. 6 is a cutaway view of the present invention showing the apertures of tile inner member in alignment with the aperture of the outer member after a force is applied to the inner member whereby the shoelace end can be inserted through both members and when inner member is released the spring will maintain the positioning of the device.

Turning to FIG. 6, therein is shown a cutaway view of the present invention 10 showing the apertures 14 of the inner member 16 in alignment with the aperture 14 of the outer member 12 after a force shown by arrow 44 is applied to the head 36 of the inner member 16 moving it inwardly whereby the shoelace end can be inserted through the apertures of both members so that when the inner member is released the spring 38 will bias member 16 outwardly. Spring 38 is shown positioned between the end 40 of the outer cylinder 12 and the tip 42 of the inner member 16. The materials of construction of the present invention are expected to be either metal or plastic or the like.

What is claimed to be new and desired to be protected by Letters Patent is set forth in the claims:

1. A method for securing the shoelaces of shoes, comprising the steps of:

a) providing an outer cylinder sized for use on human shoes having four apertures in both longitudinal walls thereof for receiving shoelaces, being open at one end for receiving an inner member;

b) providing an inner rod shaped member having four apertures in the longitudinal walls thereof for receiving shoelaces;

c) inserting movably said inner member into said outer cylinder;

d) biasing outwardly said inner member from said outer cylinder;

e) pushing said inner member inwardly into said outer cylinder in order to align said apertures of said inner member with said apertures of said outer member;

f) threading one shoelace through one pair of aligned apertures while said apertures are aligned;

g) threading said one shoelace back through an adjacent second pair of aligned apertures while said apertures are aligned;

h) threading a second shoelace through a third pair of aligned apertures while said apertures are aligned;

i) threading the second shoelace back through a fourth pair of aligned apertures while said apertures are aligned; and j) releasing said inner member, said shoelaces being secured between said apertures of said inner member and said apertures of said outer cylinder as said inner member is biased outwardly.

2. The method of claim 1, wherein said biasing further comprises the step of providing a coil spring positioned longitudinally between the base of said outer cylinder and the tip of said inner member.

3. The method of claim 1, further comprising the step of using a coiled spring to outwardly bias said inner member from said outer cylinder.

* * * * *